US005525875A

United States Patent [19]

Nakamura et al.

[11] Patent Number: 5,525,875

[45] Date of Patent: Jun. 11, 1996

[54] POWER SUPPLYING APPARATUS FOR A POWERED LATCHING MECHANISM FOR VEHICLE DOORS

[75] Inventors: Yasunori Nakamura, Yamanashi-ken; Noriaki Yamashita, Gifu-ken; Tutomu Makino, Aichi-ken, all of Japan

[73] Assignee: Mitsui Kinzoku Kogyo Kabushiki Kaisha, Tokyo, Japan

[21] Appl. No.: 372,039

[22] Filed: Jan. 12, 1995

[30] Foreign Application Priority Data

Mar. 8, 1994 [JP] Japan ..... 6-064682
Apr. 14, 1994 [JP] Japan ..... 6-100577

[51] Int. Cl.[6] ..... E05F 11/00

[52] U.S. Cl. ..... 318/266; 318/286; 318/468; 49/280

[58] Field of Search ..... 318/256, 264, 318/265, 266, 283, 286, 466, 468; 292/137, 138, 144; 49/280, 360; 180/271; 296/155

[56] References Cited

U.S. PATENT DOCUMENTS 4,968,074 11/1990 Yamagishi et al. ..... 292/201
5,189,839 3/1993 DeLand et al. ..... 49/360
5,203,112 4/1993 Yamagishi et al. ..... 49/280

FOREIGN PATENT DOCUMENTS 3115676 5/1991 Japan .
2276913 10/1994 United Kingdom .

*Primary Examiner*—Bentsu Ro
*Attorney, Agent, or Firm*—Browdy and Neimark

[57] ABSTRACT

A power supplying apparatus for a powered latching mechanism attached to a sliding door which moves along a vehicle body so as to be open and closed comprises a power supplying unit provided on the vehicle body and connected to an electric battery, a power receiving unit provided on the door and coming into contact with the supplying unit when the door is closed to a predetermined position, an electric loop which is established when both the units comes into contact with each other and in which a first electric current for detecting the contact between both the units is caused to flow, a motor controlled by the receiving unit for rotating a latch towards a full-latched position, and means for changing voltage applied to the electric loop when closing of the door is completed by the motor. When the loop is established, the supplying unit begins supplying main power to the receiving unit, and when the voltage of the loop is changed by the changing means, the supplying unit stops supplying the main power.

10 Claims, 7 Drawing Sheets

| SENSOR 41 | POSITIONS OF LATCH 12 |
|---|---|
| OFF | OPENING ~ HALF - LATCH |
| ON | HALF-LATCH ~ FULL-LATCH |
| OFF | FULL-LATCH ~ ROTATIONAL LIMIT |

POWER SUPPLYING APPARATUS FOR A POWERED LATCHING MECHANISM FOR VEHICLE DOORS

FIELD OF THE INVENTION

The present invention relates to a power supplying apparatus for a powered latching mechanism for vehicle doors.

PRIOR ARTS

Conventionally, many latching mechanisms which enable complete closing of the door in a full-latched condition using the power of a motor after the door has been manually closed to a half-latched condition have been proposed.

In a case where the powered latching mechanism is provided for a sliding door which is closed and opened by moving in a longitudinal or front-and-rear direction of the vehicle body, a special extra power supply apparatus is needed. In the sliding door, it is impossible to directly connect the powered latching mechanism mounted within the door to a battery of the vehicle with a power cable due to limitations of the structure thereof. Therefore, the power supply apparatus is divided into a power supplying unit which is adapted to be mounted in the vehicle body and connected to the battery, and a power receiving unit which is adapted to be mounted in the door and connected to the powered latching mechanism, and both the units will be electrically connected to each other when the door is closed to a predetermined position.

At least, both the units respectively have a positive terminal and a ground terminal and each terminal is exposed. When the terminals of the supplying unit are brought into contact with the terminals of the receiving unit, respectively, the battery power is supplied to the receiving unit via the supplying unit. However, the power supplying unit does not supply power as there is a danger of the positive terminals and ground terminals which are in an exposed state being short-circuited due to water and/or metallic chips, when the door is open. So, the power supplying unit begins supplying power for the first time when the door is closed to the predetermined position, i.e. a little before the full-latched position. For example, with an apparatus disclosed by Japanese Laid-open Patent No. 3-115676, a power supply switch which is turned ON by a microswitch attached to the vehicle body being pressed by the closing action of the door is provided between the positive terminals of the power supplying unit and the battery for supplying power to the power receiving unit.

A problem of the above prior art apparatus exists in the inaccuracy of the timing to commence supplying power. As the timing at which the microswitch is pressed by closing the door greatly depends upon the attaching accuracy of the microswitch, it is very difficult to precisely synchronize the instant of the switch turning ON with the instant of both units or terminals actually coming into contact with each other. Further, the switch which is provided where it is able to be pressed by the door has such a disadvantage that it is apt to cause a malfunction due to rust etc.

In order to solve these problems, the prior patent application, i.e. U.S. patent application Ser. No. 08/223,510 or UK patent application No. 9406785.7, pertaining to the same applicant or assignees as the present applicant proposes a power supplying apparatus with which actual contact between the supplying unit and receiving unit can be detected. This power supplying apparatus has a feature with which the contact between the respective units can be accurately detected without any use of a microswitch, but points to be improved such as means for halting the power supply, means for suppressing the consumption of a battery etc. still remains therein.

The prior art apparatus has a monitoring unit for detecting the rotation and stop of the motor. A representative construction of the monitoring unit is of such a type which distinguishes the stop condition of the motor from the rotational condition of the same by drawing a line between the motor amperage and the load amperage while the motor is stopped.

In a monitoring unit for measuring the load current of a motor, it is necessary to establish a reference value which will be the boundary to distinguish a normal amperage from load amperage which is greater than the normal amperage. But as the normal amperage will greatly fluctuate due to influences such as change in the atmospheric temperature and battery voltage, it is very difficult to establish the reference value. That is, in a case where the reference value is set to a higher level with the fluctuation range of the normal amperage taken into consideration, the detection of the stop of the motor is accordingly delayed, causing the response of the monitoring unit to be slowed down. On the other hand, if the reference value is set to a lower level, it will become possible to detect the stop of the motor even though the motor is still rotating.

SUMMARY OF THE INVENTION

Therefore, it is an object of the present invention to provide a power supplying apparatus with which it is possible to stop the power supply to a power receiving unit with a simple construction while maintaining the features of the our prior application. In order to achieve this object, an apparatus according to the present invention is composed so that the voltage of an electric loop formed by the power supply unit being brought into contact with the power receiving unit is changed when the operation of a powered latching mechanism is terminated, and the power supplying unit is composed so as to stop power supply to the power receiving unit when the power supplying unit detects this voltage change.

It is another object of the present invention to provide a power supplying apparatus which can detect the opening of a sliding door without the use of any microswitch. In order to achieve this object, a micro current is caused to flow in the electric loop formed by the power supplying unit being brought into contact with the power receiving unit even after the operation of the powered latching mechanism is terminated. Thereby, the electric loop which will cease to exist due to opening of the door is able to be detected.

It is still another object of the present invention to provide a power supplying apparatus with which the battery consumption is able to be suppressed when the powered latching mechanism is not in operation. In order to achieve this object, an electric current which is caused to flow to detect the opening of the door is made weaker than the electric current to detect the closing of the door.

Further, it is still another object of the present invention to accurately and quickly detect the rotating conditions of the motor. To accomplish this object, the pulsation current generated by the motor rotation is detected, and it is possible to distinguish the rotation and stop of the motor depending on whether or not the pulsation current exists.

PREFERRED EMBODIMENTS OF THE INVENTION

Figure 1:
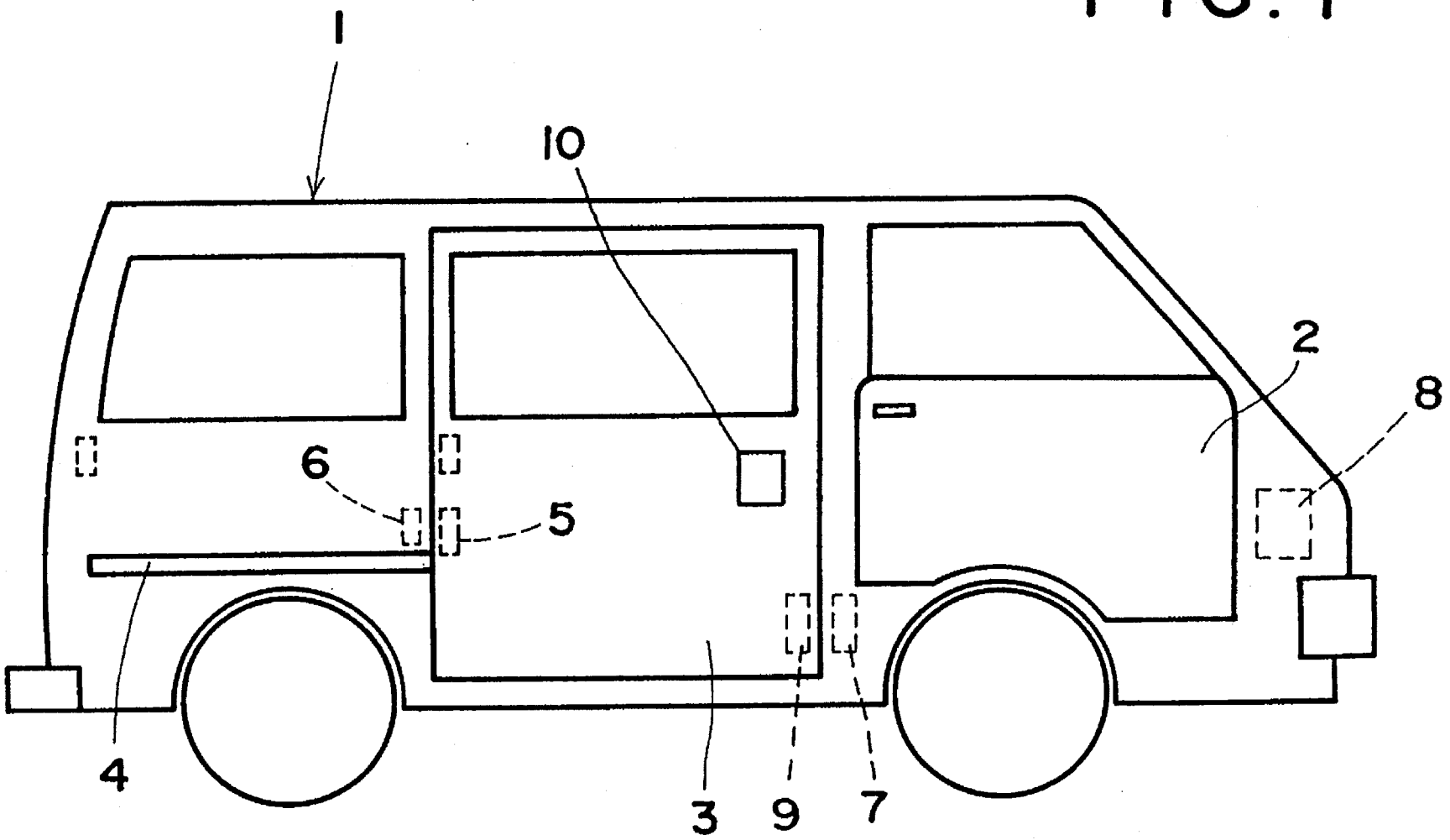
FIG. 1 is a conceptual view of a vehicle body equipped with a power supplying device according to the present invention.

As shown in FIG. 1, a vehicle body 1 has a swing type door 2 attached to the vehicle body with hinges (not shown), a sliding door 3 closed and opened by moving along a guide rail 4 extending in the longitudinal or front-and-rear direction, and an opening handle 10 of the door 3. A powered latching mechanism 5 is attached to the sliding door 3 and is engaged with and disengaged from a striker 6 fixed at the vehicle body 1.

A power supplying unit 7 connected to a battery 8 of the vehicle body 1 is attached to the vehicle body 1 and a power receiving unit or sequence unit 9 which controls the latching mechanism 5 is provided at the sliding door 3 so that it faces the power supplying unit 7. The units 7 and 9 do not contact each other and the receiving unit 9 has no power source when the door 3 is at its open condition. When the door 3 moves to a predetermined closed position, both the units 7 and 9 come into contact with each other and power of the battery 8 is supplied to the receiving unit 9 through the unit 7. A detailed method and timing at which the power supplying unit 7 supplies power to the power receiving unit 9 will be described later.

Figure 2:
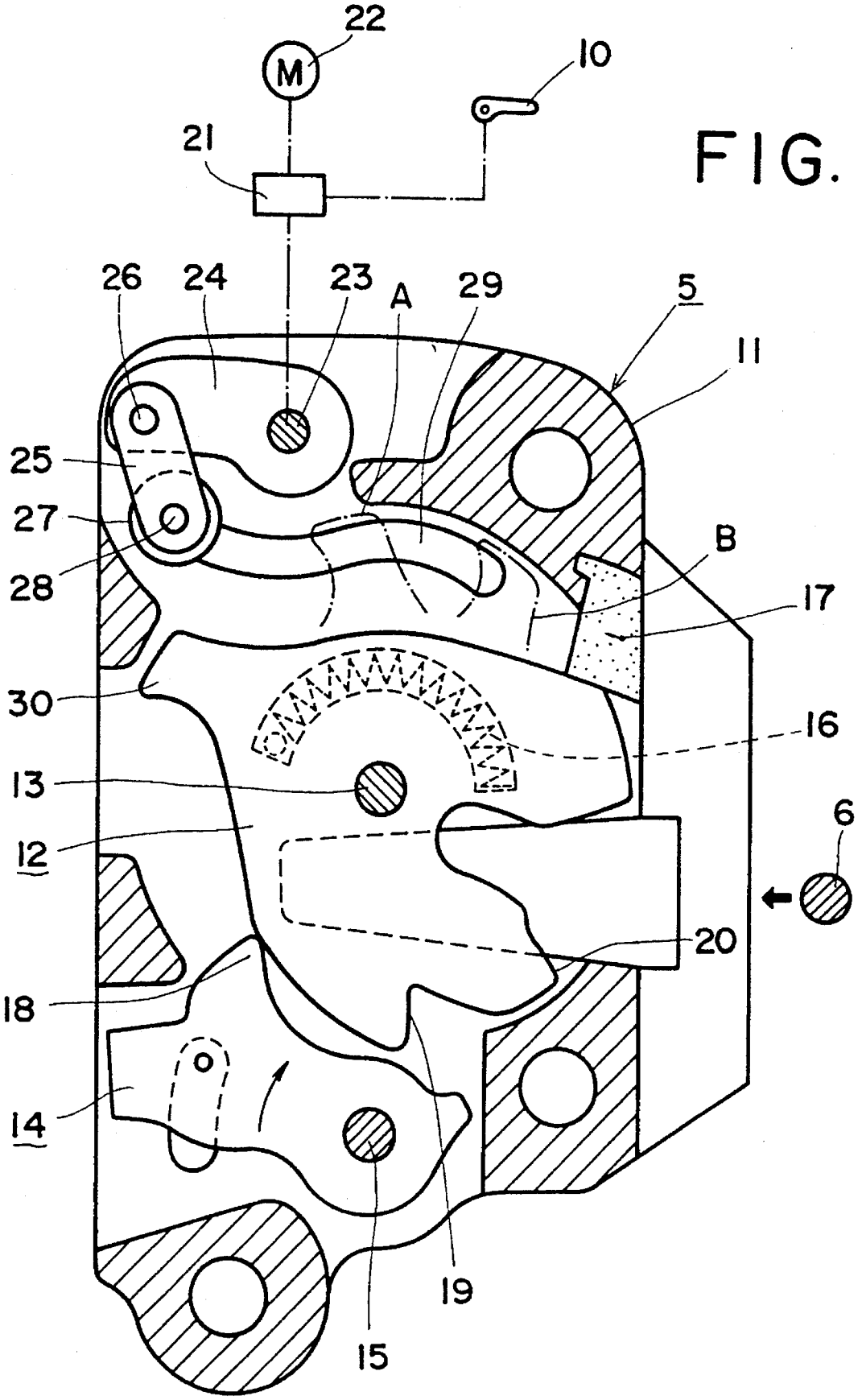
FIG. 2 is a longitudinal side view of a powered latching mechanism.

As shown in FIG. 2, the latching mechanism 5 has a synthetic resin latch body 11 in which a latch 12 engageable with the striker 6 is pivotally mounted by a latch shaft 13 and a ratchet 14 maintaining the engaged condition between the latch 12 and the striker 6 is pivotally mounted by the ratchet shaft 15. The latch 12 is urged in a counter-clockwise direction in FIG. 2 by means of a returning spring 16, and while the door is open, the latch 12 is kept in contact with a rubber stopper 17 as shown in FIG. 2. The ratchet 14 is urged in a clockwise direction by means of a spring (not shown), and with the door open, a claw 18 of the ratchet 14 is brought into contact with the outer circumference of the latch 12.

When the latch 12 is turned to a half-latched position A, shown with a single-dashed line in FIG. 2, by engagement with the striker 6, the claw 18 will be engaged with a half-latched stepped portion 19 of the latch 12, and when the latch 12 is turned to a full-latched position B, shown with a single-dashed line, the claw 18 will be engaged with a full-latched stepped portion 20 of the latch 12.

A rotating arm 24 is fixed at a rotary shaft 23 connected to a motor 22 via a power transmitting mechanism 21 having a safety mechanism. A link 25 is rotatably connected to the leading edge of the rotating arm 24 with a shaft 26. A roller 27 is attached with a guide pin 28 to the leading edge of the link 25. One end of the guide pin 28 is slidably engaged with a guide groove 29 formed at the body 11. When the rotating arm 24 is turned counterclockwise in FIG. 2 by the motor 22, the roller 27 moves rightward along the guide groove 29.

The safety mechanism of the transmitting mechanism 21 is identical to a clutch mechanism. Usually, the safety mechanism transmits rotations of the motor 22 to the rotating shaft 23. However, once the opening handle 10 of the door 3 is operated for opening, the transmitting channel between the motor 22 and the rotating shaft 23 is disconnected by the safety mechanism, thereby causing the rotating shaft to be free.

A leg 30 of the latch 12 protrudes in the radial direction of the latch shaft 13. As shown in FIG. 2, when the latch 12 moves to its half-latched position A the leg 30 overlaps with the guide groove 29. Therefore, when the rotating arm 24 is turned counterclockwise by the motor 22 under the half-latched condition, the roller 27 moves rightward and is brought into contact with the leg 30, thereby causing the latch 12 to be forcibly turned toward the full-latched position B.

Figures 5, 6:
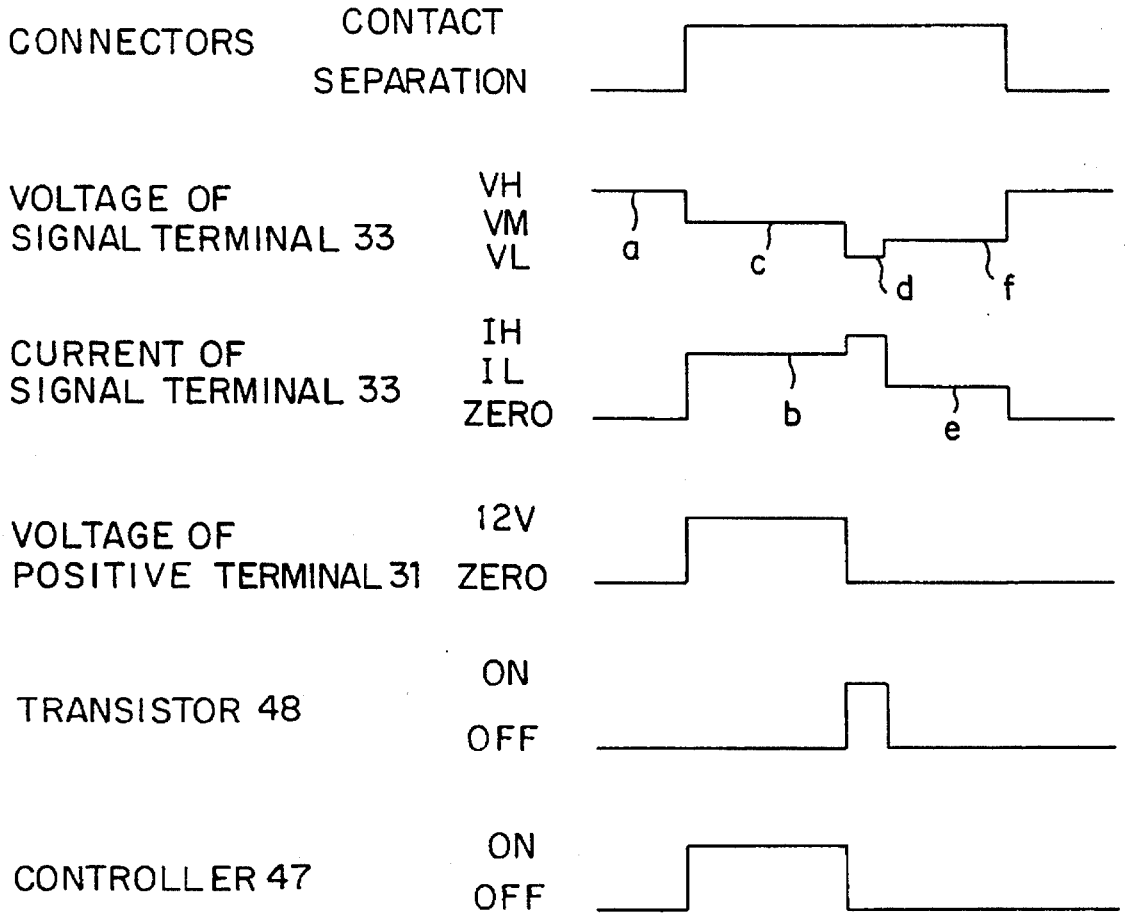
FIG. 5 is a relation view of a latch and a latch sensor.
FIG. 6 is an operation timing chart.

The latch 12 is provided with a latch sensor 41 (see FIG. 3) which can detect the rotating position of the latch 12. As a sensor 41 of the present invention, a microswitch, which is composed so that, as shown in FIG. 5, it is turned OFF when the latch 12 is located between the opening or initial position and half-latched position A, turned ON when it is located between the half-latched position A and full-latched position B, and turned OFF when it is located between the full-latched position B and the rotational limited position where the latch 12 is brought into contact with the stopper 17, is provided. However, the relationship between the sensor 41 and the latch 12 shown in FIG. 5 is not strict but is described to make it easy to understand the operations of the present invention. In an actual product, as it is necessary to turn ON the sensor without fail when the latch reaches the half-latched position, the sensor 41 is composed so that it can be turned on when the latch 12 is turned a little before the latch reaches the half-latched position. The sensor 41 may be such that it can detect the half-latched position A and full-latched position B of the latch 12, therefore, there is no limitation in the configuration thereof.

Figure 3:
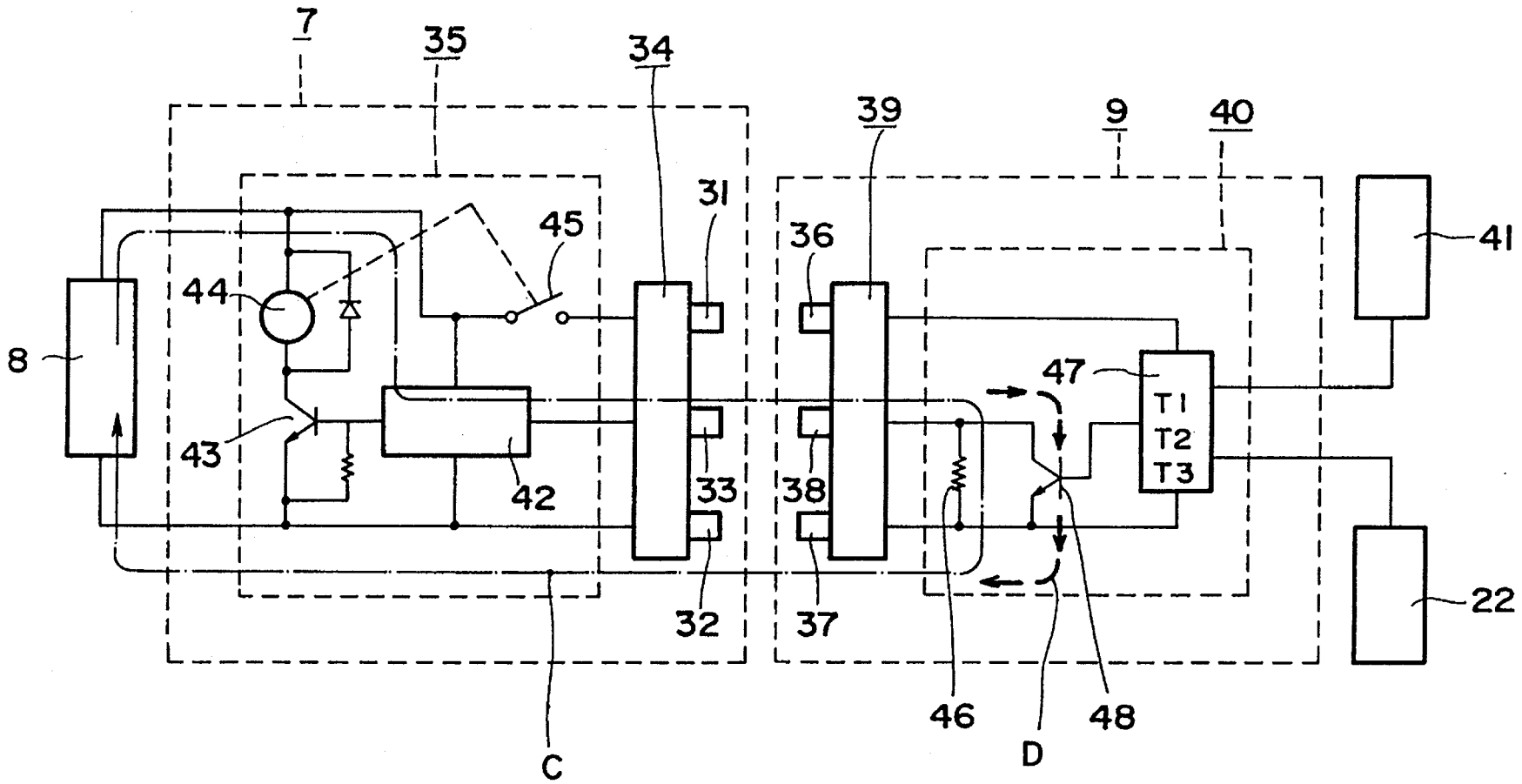
FIG. 3 is a block circuit diagram of a power supplying unit and a power receiving unit.

As shown in FIG. 3, the power supplying unit 7 has a control circuit 35 and a connector 34 consisting of a positive terminal 31, a ground terminal 32 and a signal terminal 33. The power receiving unit or sequence unit 9 has a control circuit 40 and a connector 39 consisting of a positive terminal 36, a ground terminal 37 and a signal terminal 38. A group of terminals 31 to 33 of the connector 34 and a group of terminals 36 to 38 of the connector 39 are mounted in an exposed state to the vehicle body 1 and a door 3, respectively, so that they can be brought into contact with each other when the door 3 is caused to slide in the closing direction. The timing at which both the groups of terminals are brought into contact with each other is preferably set to such a state that the latch 12 and striker 6 are barely engaged with each other, and the groups of terminals are completely brought into contact with each other when the latch 12 is turned to the half-latched position A by engagement with the striker 6.

A controller 42 of the power supplying control circuit 35 is always given power from the battery 8, thereby causing voltage to be applied to the signal terminal 33 for the purpose of detecting the contact between both the connectors 34 and 39. The voltage applied to the signal terminal 33 will be in the level VH (about 12 volts, see the portion shown with a in FIG. 6) when the connector 34 is not in contact with the connector 39. The signal terminal 38 of the power receiving connector 39 is connected to the ground terminal 37 via a resistor 46. When the connectors 34 and 39 are brought into contact with each other, an electric loop C shown with a single-dashed line in FIG. 3 is established via the resistor 46 and an electric current of the level IH (about 6 mA, see the portion shown with b in FIG. 6) flows in the electric loop C. Further, as the electric loop C is established, the voltage applied to the signal terminal 33 is caused to drop from the level VH to the level VM (about 6 volts, see the portion shown with c in FIG. 6).

The control circuit 35 has a switching transistor 43 which is turned ON by an instruction from the controller 42, a relay 44 to which electric current is supplied as the transistor 43 is turned ON, and a contact 45 of the relay 44, which contact is provided between the positive terminal 31 and the battery 8. When the voltage applied to the signal terminal 33 is caused to drop from the level VH to the level VM due to the contact between the connectors, the controller 42 supplies an electric current to the transistor 43 for causing the relay 44 to operate. Thus, the relay contact 45 is closed, the power of the battery 8 is supplied to the power receiving unit 9 via the positive terminals 31 and 36. Thus, in the present invention, as an electric loop C which is established by the contact between the connectors is detected, electric power necessary to control the motor 22 is supplied to the power receiving unit 9. So, the power supplying timing is accurate, and the operation thereof will be reliable.

The power receiving circuit or sequence control circuit 40 has a controller 47 for controlling the motor 22. As the door 3 reaches the half-latched position, the controller 47 causes the motor 22 to rotate reversely once in order to return the power transmitting mechanism 21 and roller 27 to the initial positions thereof, and thereafter causes the motor to rotate normally, thereby causing the latch 12 in the half-latched position to be forcibly turned toward the full-latched position.

The control circuit 40 has a transistor 48 whose collector and emitter are connected to the electric loop C and base is connected to the controller 47. When power closing of the door is completed by the motor 22, the controller 47 supplies electric current to the transistor 48 for only a predetermined period of time in order to inform the power supplying controller 42 of the completion of closing. As electric current is given to the base of the transistor 48, the electric current in the electric loop C is caused to flow, as shown with the arrow D, bypassing the resistor 46, and the potential difference between the signal terminal 33 and the ground terminal 32 quickly decreases, thereby causing the voltage level of the signal terminal 33 to drop from the level VM to the level VL (almost zero volts, see the portion shown with d in FIG. 6). As the power supplying controller 42 detects this voltage fluctuation, the controller 42 regards it as completion of door closing and causes the switching transistor 43 to be turned OFF. Thereby, the relay 44 is turned off to cause the relay contact 45 to be released, whereby stopping the power supply to the power receiving unit 9.

When the power supplying controller 42 senses voltage of the level VL, the controller 42 changes the circuits therein to cause the current, which flows in the electric loop C, to be lowered from the level IH (about 6mA) to the level IL (about 0.6mA, see the portion shown with e in FIG. 6). The reason why a micro current is caused to flow in the electric loop C even while the door is closed is to detect opening of the door by monitoring the electric loop C. Namely, it is possible to confirm that the door is closed while electric current is flowing in the electric loop C, and it is also possible to confirm that the connectors are disconnected due to opening of the door if the electric current flow stops. Thus, the present invention has a significant advantage with which it is possible to detect opening of a door without the use of a microswitch in which there remains a doubt in reliability. Certainly, the present invention has the disadvantage of continuously consuming electric current of the level IL while the vehicle is being parked. However, the amount of this consumption is generally less than the natural discharge of the battery, and it may be disregarded. As the amperage of the electric loop C becomes the level IL, the voltage of the signal terminal 33 becomes a value (see the portion shown with f in FIG. 6) which is considerably lower than the 6 volts exampled as level VM. However, the controller 42 is set so that it recognizes this value as voltage of the level VM.

Figure 4:
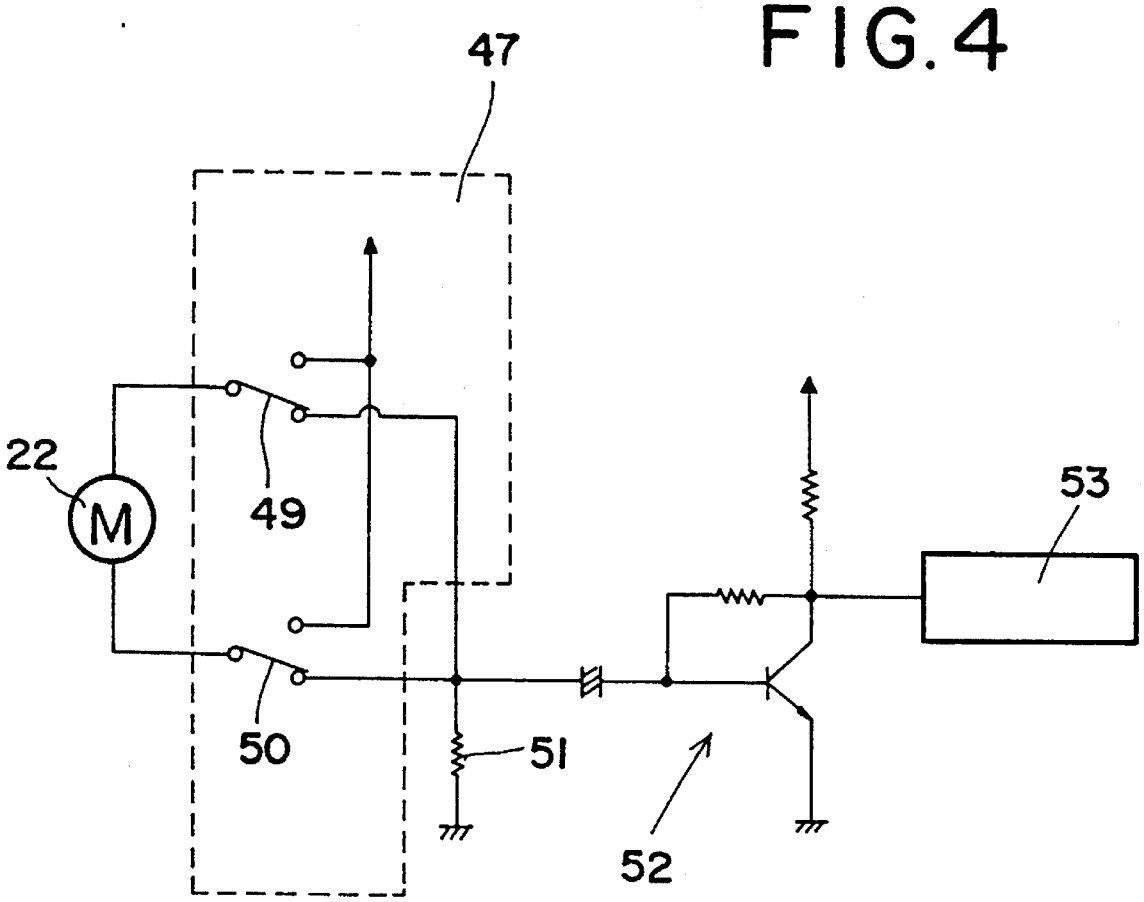
FIG. 4 is a circuit diagram for detecting the pulsation current which is generated in the motor circuits.

FIG. 4 shows a circuit diagram for detecting the pulsation current (voltage) which is generated by rotations of the motor 22. The circuit has relay contacts 49 and 50 to change the direction of rotation of the motor 22, a resistor 51 for detecting the pulsation current, an amplification circuit 52, and a pulsation distinguishing circuit 53. As the pulsation current generated by rotations of the motor 22 is a remarkably weak current as it is, it will be necessary to prepare an expensive device to measure the current. Therefore, the pulsation current is converted to pulsation voltage by utilizing the resistor 51, is amplified in the amplification circuit 52 and is outputted to the pulsation distinguishing circuit 53. The pulsation distinguishing circuit 53 checks whether the motor 22 is rotating or stopped, based on the waveform of the amplified pulsation voltage and outputs the result to the controller 47.

Operations

When a sliding door 3 is open, the power supplying controller 42 applies voltage of level VH (about 12 volts) to the signal terminal 33, and at the same time causes the switching transistor 43 to be turned off in order to interrupt power to the relay 44, and the controller 42 causes the relay contact 45 to be opened, interrupting the positive terminal 31 from the battery 8. Further, the sensor 41 for detecting the position of the latch 12 is turned off. In a door opened state, as all the power supplying terminals 31 to 33 are not in contact with other terminals, the consumption current is practically zero.

Figure 7:
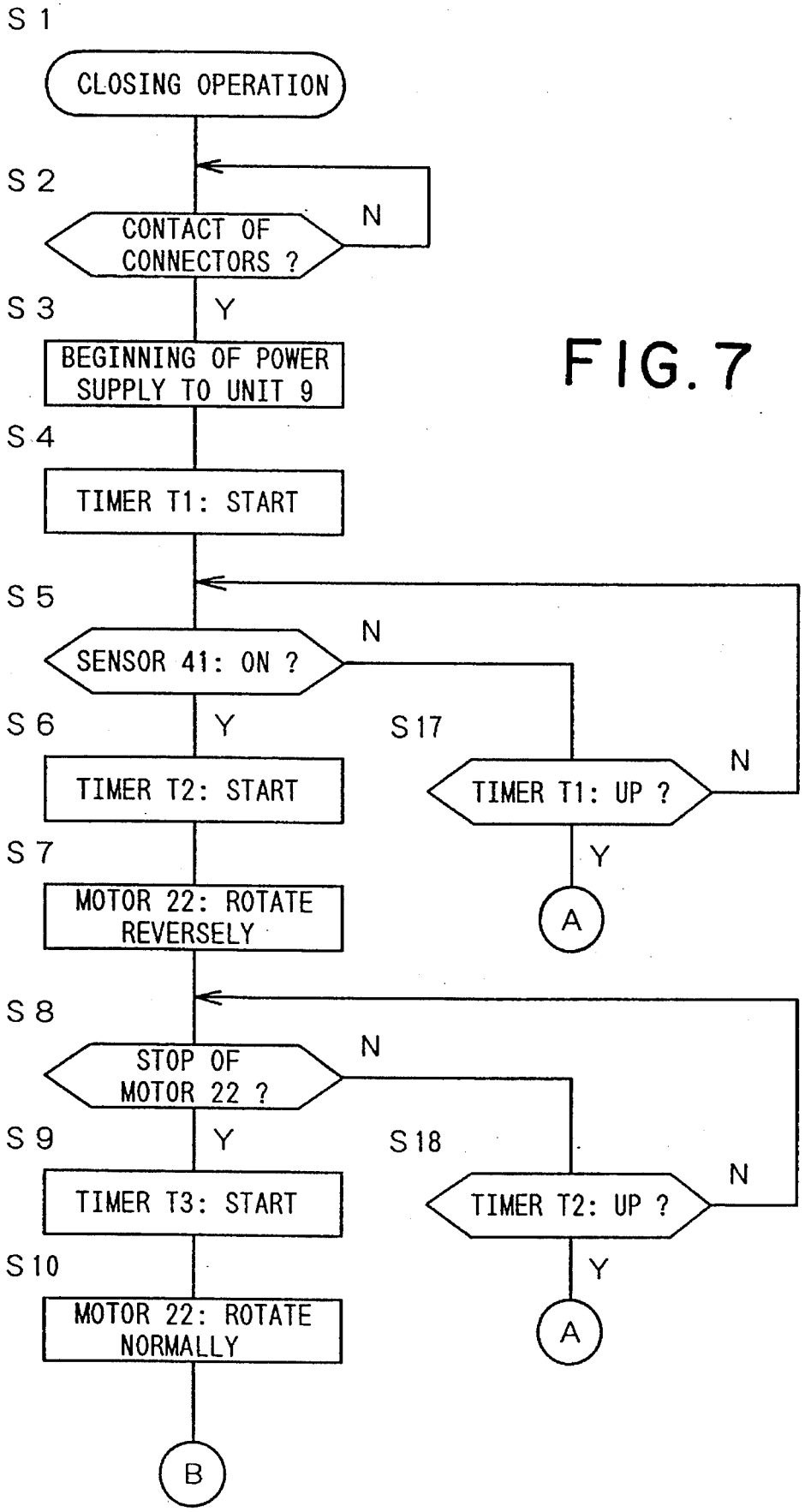
FIGS. 7 and 8 are flow charts.
Figure 8:
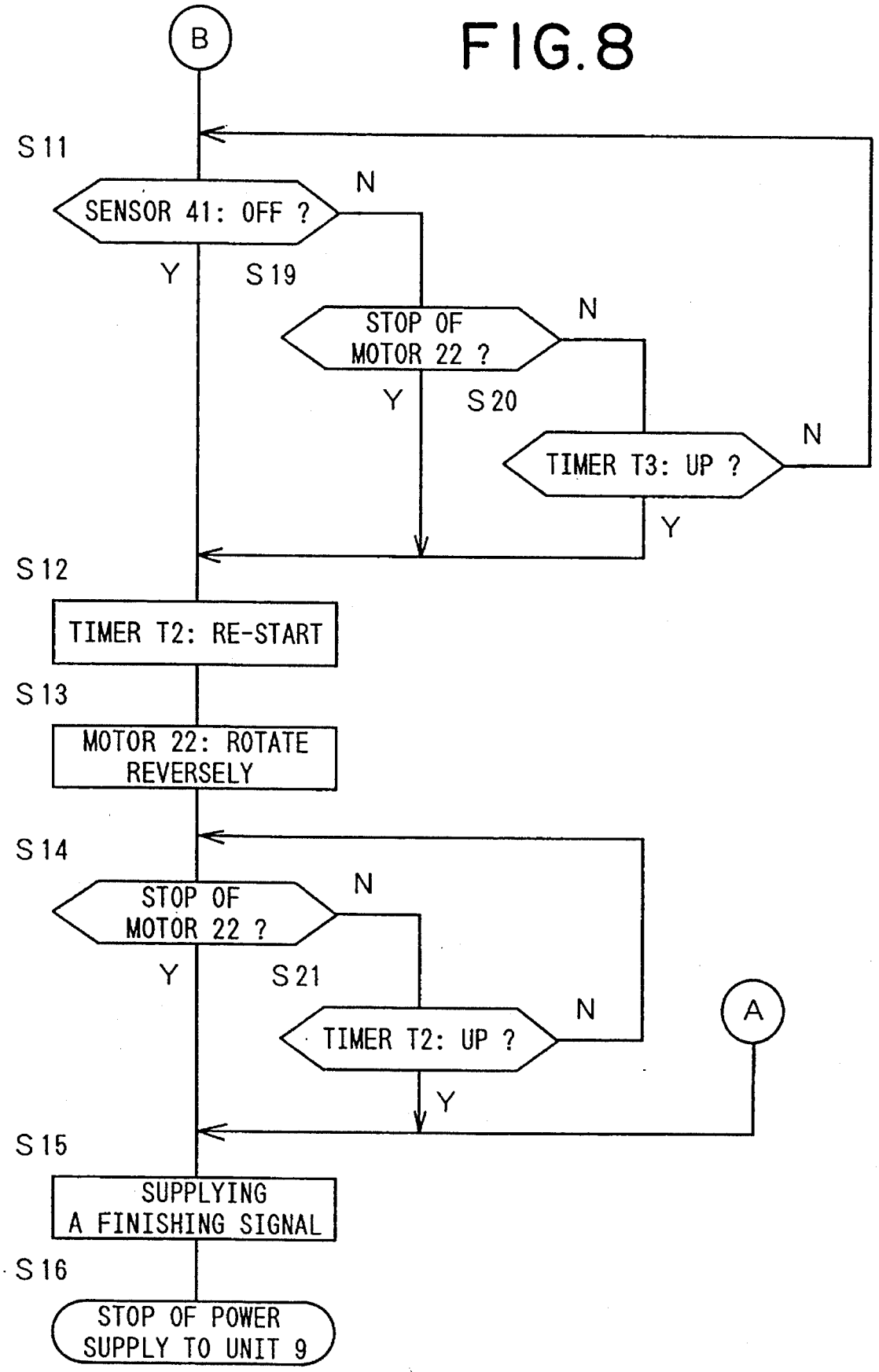

As the sliding door 3 is manually caused to slide in the closing direction to the position where the latch 12 is barely engaged with the striker 6, the group of terminals 31 to 33 of the connector 34 are brought into contact with the group of terminals 36 to 38 of the connector 39, thereby an electric loop C returning from the signal terminal 33 of the power supplying connector 34 to the ground terminal 32 of the power supplying connector 34 via the resistor 46 is established (step 2 in FIG. 7), whereby the voltage applied to the signal terminal 33 is caused to drop from the level VH to the level VM (about 6 volts), and at the same time an electric current of about 6mA of the level IH flows in the electric loop C. Thus, as the voltage of the signal terminal 33 drops to the level VM, the power supplying controller 42 supplies electric current to the relay 44 by giving electric current to the transistor 43, then, the positive terminal 21 is connected to the battery 8 by the relay 45, wherein power necessary to control the motor 22 is supplied to the power receiving unit 9 (step 3).

When power is supplied to the controller 47 of the power receiving unit 9, the controller 47 commences to drive a timer T1 incorporated therein (step 4). At this moment, the latch 12 is not yet turned to the half-latched position A and the sensor 41 is still turned off.

When the door 3 is caused to slide to the half-latched position by inertia and the latch 12 reaches the half-latched position A, the sensor 41 is turned on (step 5), thereby causing the controller 47 drive another timer T2 incorporated therein (step 6), wherein the relay contact 50 is turned ON to cause an electric current to be supplied to the motor 22 for reverse rotation (step 7). As the motor 22 is reversed, a pulsation current is generated in the electric circuit of the motor 22, and this pulsation current is converted to pulsation voltage and is outputted to the amplification circuit 53. The waveform of the pulsation voltage amplified by the amplification circuit 52 is detected by a pulsation distinguishing circuit 53. Thereby, it is detected that the motor 22 is rotating.

The reversing of the motor 22 causes the power transmitting mechanism 21, roller 27, etc to be once returned to their initial positions, wherein the respective portions are mechanically locked. When the motor 22 stops due to the mechanical locks, the pulsation in the circuit of the motor 22 disappears and the pulsation distinguishing circuit 53 detects that no pulsation is generated (step 8), then the controller 47 causes still another timer T3 incorporated therein (step 9) and the relay contact 50 is turned OFF and other relay contact 49 is turned ON for changing the direction of the electric current flowing in the motor circuits for normally rotation of the motor 22 (step 10).

When the motor 22 rotates normally, the rotating arm 24 turns counterclockwise in FIG. 2, thereby causing the roller 27 to move rightward while being guided by the groove 29 and the roller 27 to be brought into contact with the leg 30 of the latch 12 located at the half-latched position A, and causing the latch 12 to turn in the closing direction. When the latch 12 turns beyond the full-latched position B, the sensor 41 is turned OFF (step 11), thereby causing the controller 47 to re-start the timer T2 (step 12) and causing the motor 22 to rotate reversely (step 13). The roller 27 is separated from the leg 30 of the latch 12 due to reverse rotation of the motor 22, the latch 12 is returned from the over rotational position to the full-latched position B by the elasticity of the spring 16 to cause the ratchet 14 to be engaged with the full-latched stepped portion 20. Here, the full-latched condition is completed.

When the power transmitting mechanism 21, roller 27, etc are turned to the initial positions with reverse rotations of the motor 22, the motor 22 stops rotating due to the mechanical locks of the transmitting mechanism, and the pulsation detecting circuit 53 detects no pulsation in the circuit of the motor 22 (step 14). Then, the controller 47 stops supplying electric current to the motor 22 and begins supplying electric current to the base of the transistor 48 during a predetermined period of time as an operation finishing signal (step 15). With actions of the transistor 48, the potential difference between the signal terminal 33 and the ground terminal 32 quickly decreases, and the voltage applied to the electric loop C is caused to drop from the level VM (about 6 volts) to the level VL (roughly zero volts). As this voltage drop occurs, the controller 42 stops supplying electric current to the switching transistor 43 and causes the relay 44 to be turned OFF and the relay contact 45 to be opened, whereas the line between the battery 8 and power receiving unit 9 is interrupted. Simultaneously, the controller 42 causes the electric current flowing into the electric loop C to be lowered from the level IH to the level IL (about 0.6 mA). Here, all the operation of closing a door is completed.

In a door closed condition, the electric current of the level IL is continuously consumed. However, this amount of consumption is almost equivalent to or less than the amount of consumption due to natural discharge. Therefore, only a slight burden will be given to the battery. Further, as the battery 8 is interrupted from the positive terminal 31 by the contact 45, the consumption through the positive terminal 31 will be zero.

When the door 3 is opened by operation of the opening handle 10 of the door 3, both the connectors 34 and 39 are separated from each other and the electric loop C is broken. Therefore, the voltage of the signal terminal 33 increases from the level VM shown with f in FIG. 6 to the level VH. With this increased voltage, the controller 42 detects a door opened condition and waits for establishment of the next electric loop.

Described above, a pulsation current is generated in the motor circuit as the motor 22 rotates, and this pulsation current is converted to pulsation voltage by a resistor 51 and is outputted to an amplification circuit 52. In this invention, it is monitored by the pulsation distinguishing circuit 53 whether or not there is a waveform of the pulsation voltage amplified by the amplification circuit 52. And it is distinguished that the motor 22 is rotating where there is a waveform and that the motor is stopped where no waveform exists. Therefore, it is possible to easily, quickly, and accurately distinguish the rotation and stop of the motor 22. It is also possible for the pulsation distinguishing circuit 53 to monitor the conditions of the power supplying circuit to the motor 22. In a case where the power supply from the controller 47 to the motor 22 is made impossible due to interruption of a part of the power supplying line, the motor 22 does not rotate at all even though the controller 47 supplies electric current. Therefore, the pulsation judging circuit 53 will never be able to detect the pulsation. Thus, where it can not detect any pulsation even with electric current given, it is possible to regard a part of the power supplying line as being interrupted.

In a case where the positive terminal 31 and signal terminal 33 are short-circuited due to water and/or metallic chips when the relay contact 45 is turned ON, that is, power for controlling the motor 22 is supplied to the power receiving unit 9, the signal terminal 33 enters such a state that it is connected to the positive terminal of the battery 8. Therefore, the voltage of the signal terminal 33 increases from the level VM to the level VH, wherein, since the voltage of this level VH is identical to the voltage level in a door opened condition, the controller 42 stops supplying electric current to the switching transistor 43 to cause the relay contact 45 to be opened. Thereby, the connection between the battery 8 and the positive terminal 31 is interrupted.

Further, in a case where the positive terminal 31 and ground terminal 32 are short-circuited or all the three terminals 31, 32 and 33 are mutually short-circuited when power for controlling the motor is supplied to the power receiving unit 9, the voltage applied to the signal terminal 33 is caused to drop from the level VM to the level VL. As the voltage of this level VL is identical to the voltage level when the transistor 48 is turned ON, the controller 42 causes the relay 44 to be turned OFF and the relay contact 45 to be opened. Thereby, the connection between the battery 8 and the positive terminal 31 is interrupted.

Furthermore, when the signal terminal 33 and ground terminal 32 are short-circuited in a case where the connectors are apart from each other, the voltage applied to the signal terminal 33 fluctuates from the level VH to the level VL. However, as the voltage of the level VL is identical to the voltage level when the transistor 48 is turned ON, the controller 42 is kept as it is, and thereafter when the short-circuit is recovered, further operation will be continued without any influence.

Next, a description will be given of the remaining parts described in the flow charts.

In step 5, when the timer T1 is up before the sensor 41 detects the half-latched position of latch 12, that is regarded as manually closing operation being too weak, and the process advances to step 15. Then, the controller 47 stops supplying electric current to the motor 22 and begins supplying electric current to the base of the transistor 48. With actions of the transistor 48, the potential difference between the signal terminal 33 and the ground terminal 32 quickly decreases. As this voltage drop occurs, the controller 42 stops supplying electric current to the switching transistor 43 and causes the relay 44 to be turned OFF and the relay contact 45 to be opened, whereas the line between the battery 8 and power receiving unit 9 is interrupted.

In step 8, when the timer T2 is up before the pulsation distinguishing circuit 53 detects the rotation stop of the motor 22, that is regarded as the power transmitting mechanism 21 being malfunctioning, and the process advances to step 15 as described above.

In step 11, when the motor 22 stops rotating or the timer T3 is up before the sensor 41 detects the full-latched condition, that is regarded as occurrence of a malfunction, and the process advances to step 12 as described above. This malfunction corresponds to a case where foreign matter gets between the door and the vehicle body.

In the step 14, when the timer T2 is up before the rotation of the motor 22 stops, that is regarded as occurrence of a malfunction of the force transmitting mechanism 21, and electric current is caused to flow in the transistor 48 to finish the control.

What is claimed is:

1. A power supplying apparatus for a powered latching mechanism attached to a sliding door which moves along a vehicle body so as to be open and closed, comprising:

a power supplying unit provided on the vehicle body and connected to an electric battery of the vehicle;

a power receiving unit provided on the door, said receiving unit being adapted to mutually contact with the supplying unit when the door is closed to a predetermined position;

an electric loop which is established when the receiving unit comes into mutual contact with the supplying unit and in which a first electric current for detecting the contact between both the units is caused to flow;

a motor controlled by the receiving unit for rotating a latch towards a full-latched position; and means for changing voltage applied to the electric loop when closing of the door is completed by the motor;

wherein when the electric loop is established, the supplying unit begins supplying main power for controlling the motor to the receiving unit, and when the voltage of the electric loop is changed by the changing means, the supplying unit stops supplying the main power.

2. A power supplying apparatus according to claim 1, wherein the power supplying unit supplies a second electric current weaker than the first electric current in the electric loop after the supplying unit stops supplying the main power, and wherein the stopping of the second electric current is regarded as the door being opened.

3. A power supplying apparatus according to claim 1, wherein the power supplying unit has a positive terminal connected to the battery via a switch, a ground terminal and a signal terminal, and the switch is adapted to be closed by the power supplying unit when the supplying unit detects the electric loop.

4. A power supplying apparatus according to claim 1, wherein the changing means is a transistor connected to the electric loop.

5. A power supplying apparatus according to claim 1, further comprising detecting means connected to an electric circuit of the motor for detecting pulsation current flowing in the circuit, and wherein when the detecting means detects no pulsation current in the motor circuit while the receiving unit supplies the main power to the motor, the receiving unit regards it as the stop of the motor rotation.

6. A power supplying apparatus according to claim 5, further comprising a sensor for detecting a half-latched position and the full-latched position of the latch, and wherein the receiving unit supplies the main power to the motor for closing the door when the sensor detects the half-latched position, and the receiving unit supplies the main power to the motor for reverse rotation when the detecting means detects no pulsation current in the motor circuit while the receiving unit supplies the main power to the motor for closing the door.

7. A power supplying apparatus according to claim 5, further comprising a transmitting mechanism for transmitting the rotation of the motor to the latch and a sensor for detecting a half-latched position and the full-latched position of the latch, and wherein the receiving unit supplies the main power for reverse rotation to the motor in order to cause the transmitting mechanism to return to an initial position thereof when the sensor detects the full-latched position and stops supplying the main power to the motor when the detecting means detects no pulsation current in the motor circuit while the receiving unit supplies the main power to the motor for reverse rotation.

8. A power supplying apparatus according to claim 5, further comprising a transmitting mechanism for transmitting the rotation of the motor to the latch and a sensor for detecting a half-latched position and the full-latched position of the latch, and wherein the receiving unit supplies the main power for reverse rotation to the motor in order to cause the transmitting mechanism to return to an initial position thereof when the sensor detects the half-latched position and supplies the main power to the motor for closing the door when the detecting means detects no pulsation current in the motor circuit while the receiving unit supplies the main power to the motor for reverse rotation.

9. A power supplying apparatus according to claim 8, wherein the receiving unit has a first timer which starts to drive upon receiving the main power from the supplying unit, and when the first timer is up before the sensor detects the half-latched position, the receiving unit makes the changing means to operate for changing the voltage of the electric loop.

10. A power supplying apparatus according to claim 9, wherein the receiving unit has a second timer which starts to drive when the main power is supplied to the motor for closing the door, and the receiving unit supplies the main power for reverse rotation to the motor when the second timer is up before the sensor detects the full-latched position.

* * * * *